US007931573B2

(12) United States Patent
Shinomiya et al.

(10) Patent No.: US 7,931,573 B2
(45) Date of Patent: Apr. 26, 2011

(54) EXERCISE ASSISTING APPARATUS

(75) Inventors: Youichi Shinomiya, Ibaraki (JP); Takahisa Ozawa, Katano (JP); Yuritsugu Toyomi, Shimonoseki (JP); Minoru Kawamoto, Hikone (JP)

(73) Assignee: Panasonic Electric Works Co., Ltd., Osaka (JP)

( * ) Notice: Subject to any disclaimer, the term of this patent is extended or adjusted under 35 U.S.C. 154(b) by 0 days.

(21) Appl. No.: 12/599,382

(22) PCT Filed: May 12, 2008

(86) PCT No.: PCT/JP2008/058700
§ 371 (c)(1),
(2), (4) Date: Nov. 9, 2009

(87) PCT Pub. No.: WO2008/140068
PCT Pub. Date: Nov. 20, 2008

(65) Prior Publication Data

US 2010/0234196 A1 Sep. 16, 2010

(30) Foreign Application Priority Data

May 14, 2007 (JP) ..... 2007-128505

(51) Int. Cl.
*A63B 26/00* (2006.01)

(52) U.S. Cl. ..... 482/142

(58) Field of Classification Search ..... 482/142, 482/139, 92, 51, 63, 66, 93–95, 907–909
See application file for complete search history.

(56) References Cited

U.S. PATENT DOCUMENTS

| | | | | |
|---|---|---|---|---|
| 6,522,838 | B1 * | 2/2003 | Natsume et al. | 396/76 |
| 2006/0229170 | A1 * | 10/2006 | Ozawa et al. | 482/92 |
| 2007/0123401 | A1 * | 5/2007 | Ozawa et al. | 482/148 |
| 2008/0312040 | A1 * | 12/2008 | Ochi et al. | 482/8 |
| 2009/0017990 | A1 * | 1/2009 | Ochi et al. | 482/6 |
| 2010/0010397 | A1 * | 1/2010 | Ochi et al. | 601/27 |
| 2010/0022370 | A1 * | 1/2010 | Ochi et al. | 482/146 |
| 2010/0093495 | A1 * | 4/2010 | Ozawa et al. | 482/8 |
| 2010/0093505 | A1 * | 4/2010 | Shinomiya et al. | 482/142 |
| 2010/0137105 | A1 * | 6/2010 | McLaughlin | 482/8 |

FOREIGN PATENT DOCUMENTS

| | | | |
|---|---|---|---|
| JP | 63-53148 | A | 3/1988 |
| JP | 2001-74999 | A | 3/2001 |
| JP | 2002-24055 | A | 1/2002 |
| JP | 2005-58733 | A | 3/2005 |
| JP | 2005-205936 | A | 8/2005 |
| JP | 2007-89650 | A | 4/2007 |

OTHER PUBLICATIONS

International Search Report for the Application No. PCT/JP2008/058700 mailed Jun. 10, 2008.

* cited by examiner

*Primary Examiner* — Lori Baker
(74) *Attorney, Agent, or Firm* — Cheng Law Group, PLLC

(57) ABSTRACT

An exercise assisting apparatus includes a seat supporting buttocks and a foot base supporting the bottom of the feet, and is arranged to swing the seat for contracting leg muscles. An elevator mechanism regulates a position of the seat. A display and manipulator unit has a physique designating section providing a plurality of classes classified according to the user's height, and a moving direction instructing section with push-buttons instructing the moving direction of the elevator mechanism. The elevator mechanism is controlled by an elevator controller, and includes a position adjusting section configured to read out a position of the elevator mechanism corresponding to the physique designated at the physique designating section for rough adjustment of the position of the elevator mechanism and a position modifying section configured to make a precise adjustment of the position of the elevator mechanism while the moving direction instructing section is manipulated.

12 Claims, 8 Drawing Sheets

EXERCISE ASSISTING APPARATUS

TECHNICAL FIELD

The present invention relates to an exercise assisting apparatus of a passive type which comprises a seat for supporting the user's buttocks and a foot supporting surface for bearing on which the user's feet resting. The exercise assisting apparatus is configured to vary the seat by using a drive source for varying the weight of the user acting on the legs of the user.

BACKGROUND ART

Japanese Unexamined Patent Application Publication No. 2005-58733 and Japanese Unexamined Patent Application Publication No. 2007-89650 propose an exercise assisting apparatus in the prior art wherein a thigh muscle group is tensed and relaxed with hardly any extension of the knee, by displacing a seat with the user's feet resting on a foot supporting surface and the user's buttocks supported on a contact surface of the seat. This exercise assisting apparatus varies the user's weight acting on the user's legs by changing the ratio of the user's weight supported by a seat by displacing the position of the seat.

By an operation of this kind, the load is reduced compared to a case where the whole weight acts on the user's legs, and the thigh muscles are contracted with hardly any extension of the knee, whereby, for example, even a user having knee pain such as a patient with diabetes is able to strengthen the muscle group of the thigh, and furthermore since the muscle group of the thigh has a large volume, it is also expected to obtain a contribution to improvement in lifestyle-related diseases, by glucose metabolism associated with the muscular contraction. Moreover, by using a drive source to displace the seat, the user is able to exercise passively without exerting muscular force spontaneously, and therefore the load is light and consequently the apparatus can be used even by person's having a low capacity of movement.

An exercise assisting apparatus having the above composition tenses and relaxes the thigh muscle group by changing the weight of the user that acts on the user's legs, with virtually no extension of the knees, and therefore the knee bending angle is an important factor in performing exercise effectively. As the analogy of a squatting movement readily shows, the load acting on the muscle group of the thigh varies with the knee bending angle. Furthermore, in the case of a user with knee pain, if a load acts on the user's knee while the knee is bent to a certain degree, the user often experiences pain and the bending angle must be restricted in order to make an apparatus usable by persons of this type as well.

At the present time, experimental results have been obtained indicating that the exercising effect is high and knee pain is not liable to occur, if the knee bending angle (in practice, the measured angle is that formed between the thigh and the lower leg on the front side of the knee) is set to 140 degrees, and hence this angle has been set as an appropriate angle.

Japanese Patent Application Publication No. 2007-89650 describes a composition which enables adjustment of the position of a seat in such a manner that the knee bending angle becomes a proper angle. The position of the seat when the knee bending angle becomes a proper angle varies depending on the user's physique, and therefore Japanese Patent Application Publication No. 2007-89650 describes, as technology for adjusting the position of the seat, technology whereby users' physiques, such as users' height and weight, are divided into a plurality of classes and the position of the seat is adjusted in stages by designating one of the respective classes, and technology whereby the position of the seat is adjusted continuously by designating a moving direction of the seat.

The former technology has a merit in that usability is good since the position of the seat is adjusted to a proper position simply by the user selecting the range of his or her own physique, but since only the range of height or weight is designated, then it is not possible to achieve adjustments in account of individual differences, and situations where the knee bending angle does not become a proper angle may arise in the case of users who differ significantly from the standard value of leg length.

On the other hand, the latter technology makes it possible to adjust the position of the seat continuously, and therefore it is possible to adjust the knee bending angle to a proper angle, regardless of the length of the user's legs. Furthermore, since the range of height or weight is displayed by combining use of a display device, then it is possible to adjust the position of the seat in such a manner that the knee bending angle becomes a proper angle regardless of the user's physique, by adjusting the seat position to the vicinity of the user's own physique.

However, if there is a large difference between users' physiques when a plurality of users employ the apparatus successively, then the position of the seat must be adjusted continuously by using the display on the display device as a general guide, and the operating time until the seat position has been adjusted in such a manner that the knee bending angle becomes a proper angle may become long.

DISCLOSURE OF THE INVENTION

The present invention was devised in view of the problems described above, an object thereof being to provide an exercise assisting apparatus which enables adjustment of the position of a seat in stages in such a manner that the knee bending angle becomes a proper angle by taking the user's physique as a general guide, as well as enabling adjustment in account of individual differences.

The exercise assisting apparatus relating to the present invention comprises: a seat having a contact surface configured to support thereon a buttock of a user with the user's feet resting on a predetermined foot supporting surface; a seat driving mechanism configured to use a driving source for displacing the seat in a direction of varying the user's weight acting on the user's legs; and an elevator mechanism configured to regulate a position of the contact surface of the seat in order to keep a user's knee bending angle at a prescribed angle while the user is sitting on the seat held at a reference position with the user's feet placed on a predetermined position on the foot supporting surface; a manipulator section configured to instruct the position of the contact surface of the seat to be regulated by the elevator mechanism; and an elevator controller configured to control the elevator mechanism for regulating the position of the seat in accordance with an instruction of the manipulator section. The manipulator section comprises: a plurality of physique designating sections configured to designate one of physique classes classified according to users' physiques; and a moving direction instructing section configured to instruct a direction of moving the seat, and the elevator controller comprises: a data memory configured to store a relationship between each of the physique classes and a position of the elevator mechanism corresponding to the position of the seat; a position adjusting section configured to move the elevator mechanism to the position determined in the data memory as associated with the physique class designated by the physique designating section; and a position modifying section configured to move the elevator mechanism in a direction instructed by the moving direction instructing section and while the direction is being instructed.

Therefore, by instructing the position of the elevator mechanism in accordance with the physique class designated by the physique designating sections, it is possible to regulate the seat to a position whereby the user's knee bending angle becomes close to a proper angle by taking the user's physique as a rough guide. Moreover, by instructing the direction in which the elevator mechanism is moved by means of the moving direction instructing section, it is possible to make fine adjustment of the position of the seat in such a manner that the user's knee bending angle becomes a proper angle. In other words, after regulating the position of the seat roughly by using the user's physique as a general guide, it is possible to adjust the position of the seat accurately so as to match the user's physique. As a result of this, it is possible to adjust the seat position quickly and accurately.

Desirably, the manipulator section includes a final instructing section configured to provide a final instruction of regulating the position of the seat by the elevator mechanism to the elevator controller, the elevator controller being configured to disable the seat driving section from displacing the seat until the final instruction section is operated, and to disable the elevator mechanism from moving, but to allow the seat driving section to displace the seat after the final instruction section is operated.

In this way, the final instructing section disables displacement of the seat by the seat driving section until the position of the seat is confirmed, and therefore exercise by displacement of the seat driving section is only performed after the user has adjusted the seat to a proper position, and it is possible to prevent the user from unintentionally starting exercise during the process of adjusting the knee bending angle to a proper angle.

Desirably, the exercise assisting apparatus according to the present invention comprises: a load sensor configured to detect a load acting on at least one of the seat and the foot supporting surface, and a proper load memory configured to store an output value of the load sensor as a proper value when the user's knees are bent at the prescribed angle with the user's buttocks placed on the seat held at the reference position and with the user's feet resting on the foot supporting surface. In this case, the elevator controller disables displacement of the seat by the seat driving section before the output value of the load sensor during movement of the elevator mechanism coincides with a value stored in the proper load memory, and halts movement of the elevator mechanism and allows displacement of the seat by the seat driving section, when the output value of the load sensor has coincided with the stored value.

By means of this composition, at the point in time when the load measured by the load sensor coincides with the load stored in the proper load memory during the movement of the elevator mechanism, it is judged that the knee bending angle has become a proper angle, and the movement of the elevator mechanism is halted and displacement of the seat is allowed. Consequently, the movement of the seat is automatically halted if the knee bending angle becomes the proper angle during fine adjustment of the seat position by operation of the moving direction instructing section. In other words, there is no need to measure whether or not the knee bending angle is a proper angle, and usability is improved.

Moreover, the elevator controller comprises a position memory configured to store a position of the elevator mechanism when the seat driving section starts displacing the seat, and the manipulator section comprises a pre-position instructing section configured to move the elevator mechanism to the position stored in the position memory. According to this composition, since the position of the elevator mechanism at the start of exercising is stored and this position can be used in the next exercising operation, then there is no need to regulate the position of the seat each time exercising is performed and therefore the usability of the apparatus is improved.

Desirably, the position memory includes memory areas configured to store the positions of the elevator mechanism with regard to a plurality of users, and the pre-position instructing section comprises a user selector configured to select one of the positions stored respectively in the memory areas of the position memory for instruction of the position of the elevator mechanism. In this case, since the position of the elevator mechanism at the start of exercising is stored in respect of a plurality of users and this position can be used in a subsequent exercising operation, then when the apparatus is used by a plurality of persons, it is sufficient for each user simply to select their own position, and hence there is no need to regulate the position of the seat each time exercising is performed and the usability of the apparatus is therefore improved.

Moreover, desirably, the elevator mechanism comprises a position sensor configured to detect a position corresponding to the contact surface of the seat. In this case, the position adjusting section is configured to determine the position instructed by the manipulator section as a target position, and stop the elevator mechanism when the position sensor provides an output which corresponds to the target position while the elevator mechanism is moving. Therefore, it is possible to make the seat position coincide accurately with a target position.

BEST MODE FOR CARRYING OUT THE INVENTION

First Embodiment

Figure 1:
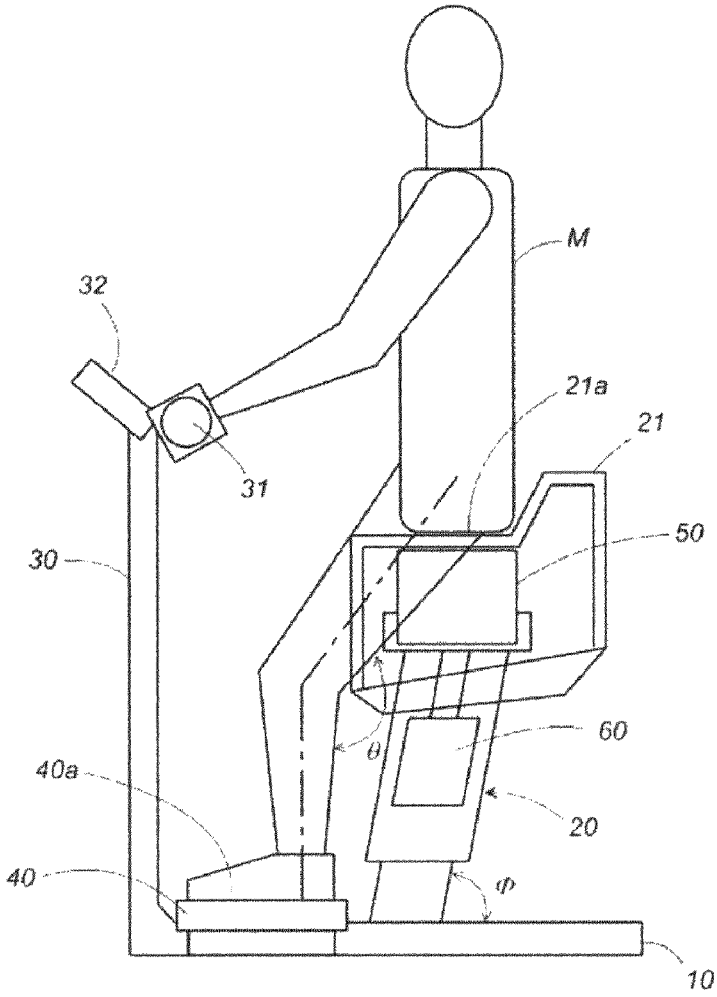
FIG. 1 is a schematic side view showing an exercise assisting apparatus relating to a first embodiment of the present invention.
Figure 2:
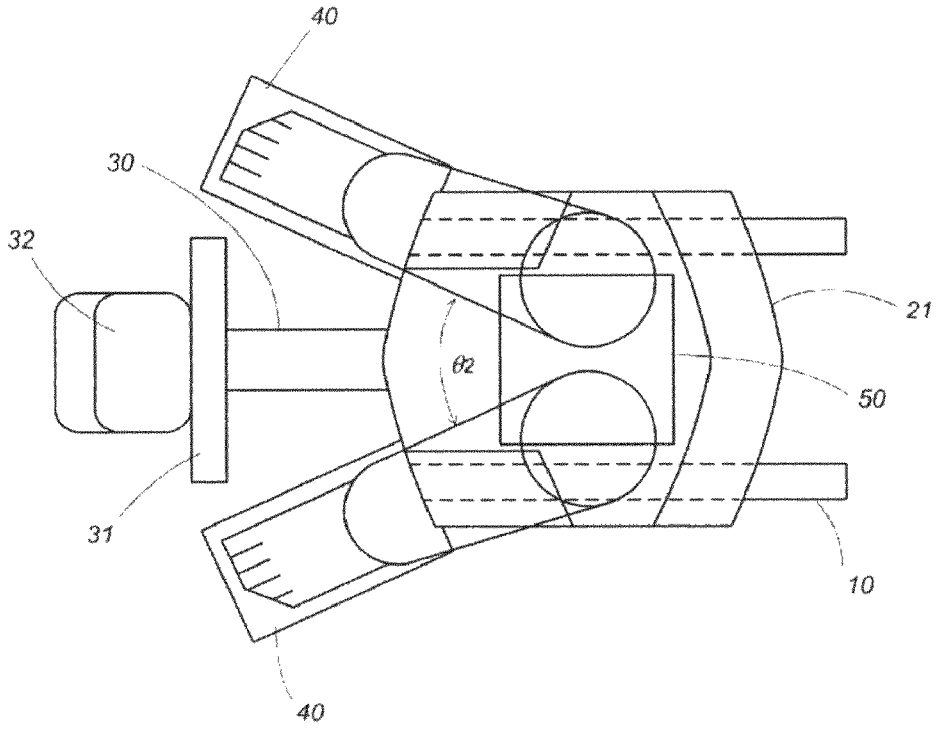
FIG. 2 is a schematic plan view of the exercise assisting apparatus.

As shown in FIG. 1 and FIG. 2, the exercise assisting apparatus relating to one embodiment of the present invention has a base 10 which is disposed in a fixed position on a floor, or the like, and provided on top of this base 10 are: a seat support base 20 having a seat 21 which supports the buttocks of a user M provided on the upper end thereof, and a handle post 30 having a handle 31 which the user M grips with his or her hands as necessary provided on the upper end thereof. A foot stand 40, the upper surface of which forms a foot supporting surface 40*a*, is provided at a position between the seat support base 20 and the handle post 30, on the base 10. The foot stand 40 restricts the position of the user's feet by means of the user M placing his or her feet on the foot supporting surface 40*a*.

Provided on the seat support base 20 are: a seat driver 50 which causes the seat 21 to oscillate, and an elevator mechanism 60 which raises and lowers the seat 21 and the seat driver 50 with respect to the base 10. The composition of the seat driver 50 and the elevator mechanism 60 is described below.

The seat driver 50 changes the weight of the user M that acts on the user's knees, by altering the position of the user's buttocks through using a drive source to oscillate the seat 21 with respect to the user M in a state where the user's buttocks are placed on the contact surface 21*a* of the seat 21 and the user's feet are placed on the feet supporting surface 40*a* of the foot stand 40. In other words, in a state where the body weight of the user M is supported in a distributed fashion by the buttocks and the legs, the weight supported by the buttocks is increased or decreased, and consequently the weight acting on the legs is changed, by altering the position of the buttocks.

When the knees are bent by a prescribed angle, then if the ratio of the body weight supported by the seat 21 is decreased, the load acting on the thighs of the user M is increased and the muscle group of the thigh region can be made to contract, similarly to bending the knees by performing a squat movement. In other words, when the seat 21 is caused to oscillate by the drive source, the thigh muscle groups repeat a tensing and relaxing action by means of a passive movement which is not a spontaneous movement of the user M. In other words, it is possible principally to exercise the thigh region by means of the seat driver 50 causing the seat 21 to oscillate.

The direction of oscillation of the seat 21 is desirably set in such a manner that no shearing force acts on the knee joints. When the buttocks of the user M are supported by the contact surface 21*a* of the seat 21, the user M's feet naturally adopt an attitude where the distance between the toe tips is greater than the distance between the heels, as shown in FIG. 2, and the angle of opening θ2 between the feet can be determined from the position where the feet are placed on the foot stand 40. Therefore, it is possible to exercise without applying a shearing force to the knee joints by oscillating the seat 21 in a direction following the central lines that link the heels and the tips of each foot when the user's feet are placed on the foot stand 40. In other words, by providing a time period during which the seat 21 moves obliquely rightwards and forwards and a time period during which the seat 21 moves obliquely leftwards and forwards when the seat 21 moves forward from the rear end position in the range of oscillation, then it is possible to make the user's weight act respectively on the thigh area of the left and right legs, without applying a shearing force to the knee joints.

Figure 3:
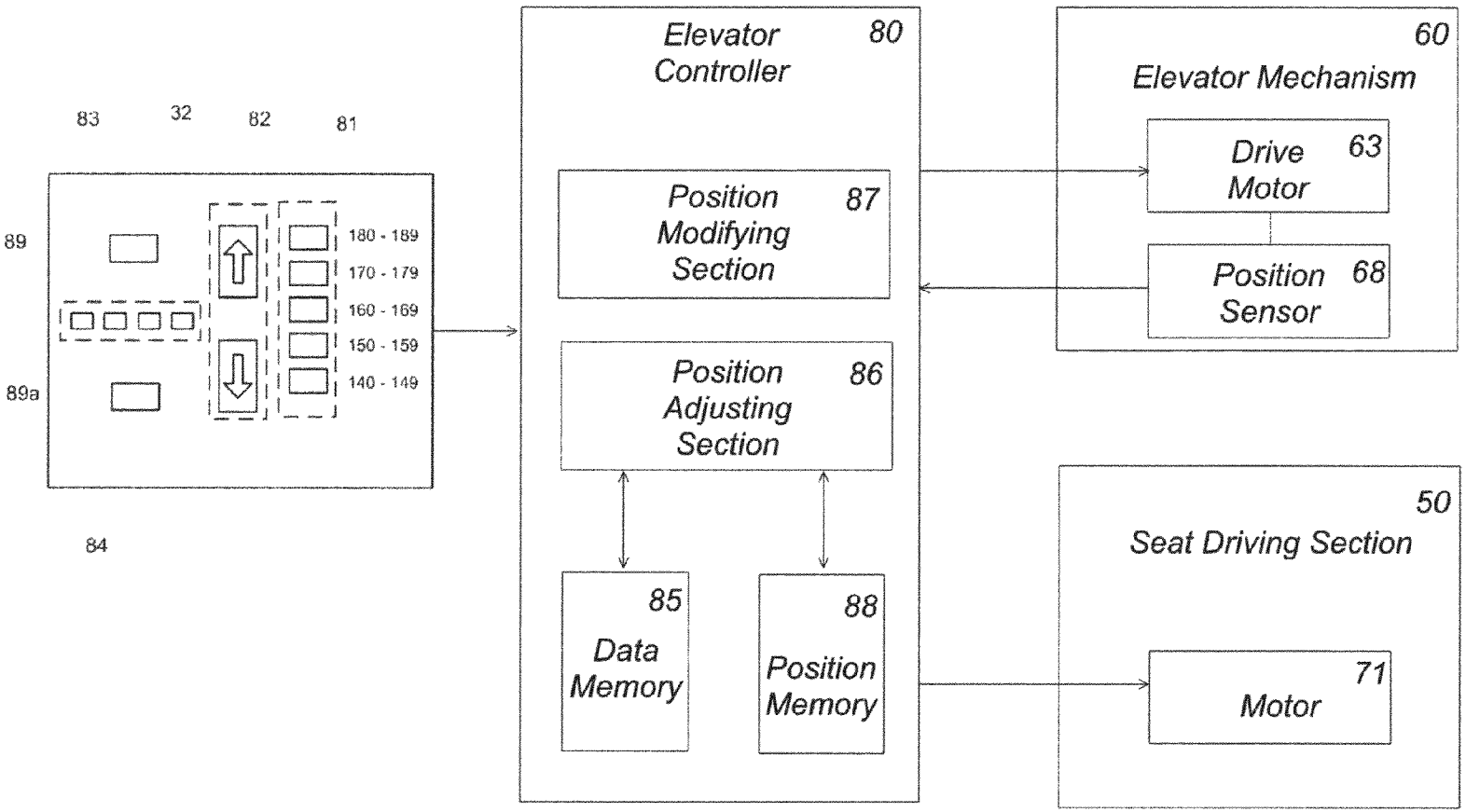
FIG. 3 is a block diagram of elements which achieve adjustment of the seat position in the exercise assisting apparatus.

In an embodiment shown in FIG. 3, the contact surface 21*a* which is the upper surface of the seat 21 is a substantially horizontal surface, but taking account of the fact that exercise which stimulates muscular contraction of the thigh muscle group is performed by changing the weight of the user M that is acting on the user's legs, then it is desirable that the contact surface 21*a* of the seat 21 making contact with the buttocks of the user M should be inclined downwardly in the forward direction of the direction of oscillation of the seat 21. In other words, desirably, the portion which supports the right buttock area of the user M in the front end portion of the seat 21 in inclined obliquely downwards in the rightward and forward direction and the portion which supports the left buttock area of the user M is inclined obliquely downwards in the leftward and forward direction. If a shape of this kind is adopted, then when the seat 21 is moved forward from the rear end position of the oscillation range, the user's weight acting on the legs is liable to increase and the exercising effect can be raised.

A control and display apparatus 32 is provided in the central part of the handle 31 on the upper end portion of the handle post 30, and operations such issuing instructions in respect of the operation of the seat driver 50 and the elevator mechanism 60, and displaying measures indicating the amount of exercise, and the like, are performed on this control and display apparatus 32. The user M is able to stabilize the position of his or her upper body by gripping the handle 31.

Figure 4:
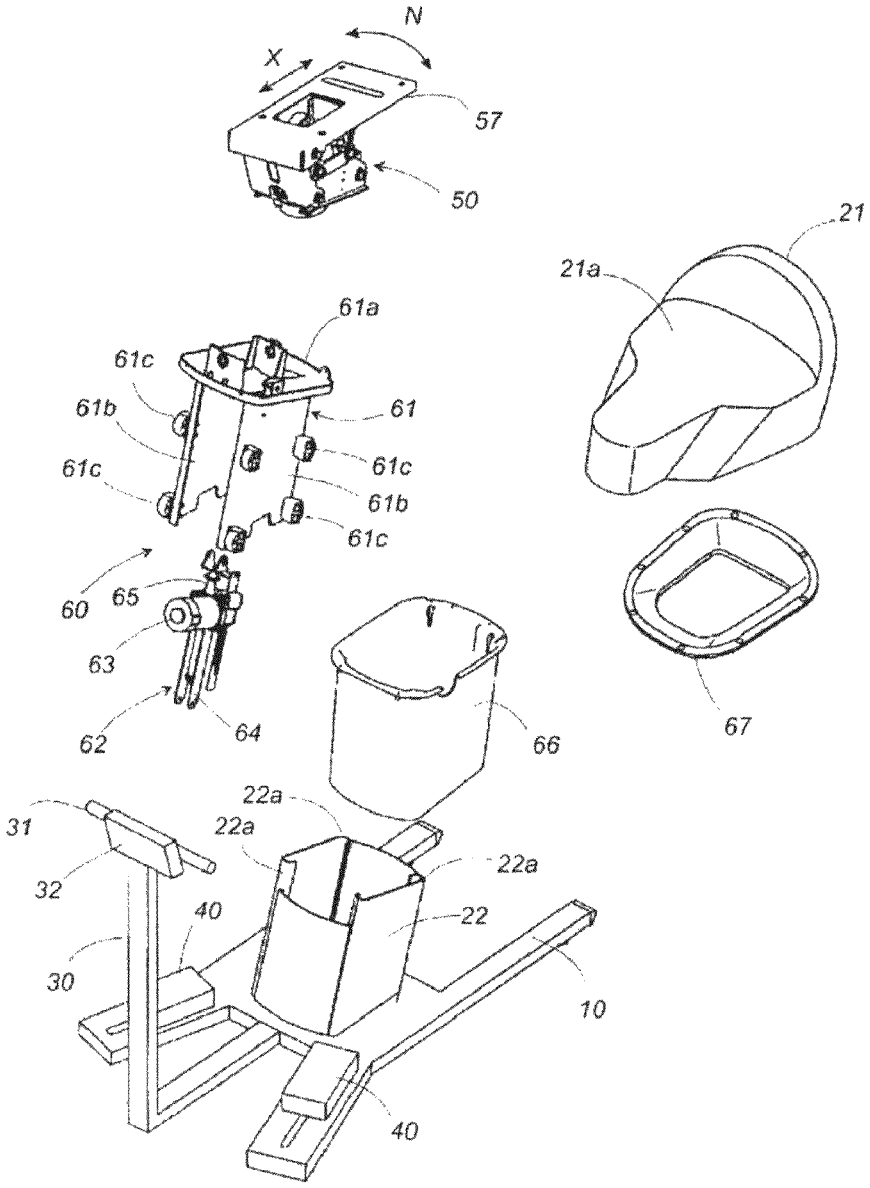
FIG. 4 is an exploded perspective diagram of the exercise assisting apparatus.

The structure of the seat support base 20 is described in more detail below. As shown in FIG. 4, the seat support base 20 has a hollow supporting column 22 which is erected on the base 10, and the lower end portion of the elevator mechanism 60 is accommodated inside the supporting column 22. The elevator mechanism 60 has an elevator base 61 which ascends and descends slidably with respect to the supporting column 22, and the seat driver 50 is mounted on the upper end of the elevator base 61. Consequently, the seat driver 50 is able to move with respect to the base 10, together with the seat 21.

The center line of the supporting column 22 is a straight line which is inclined rearwardly with respect to the vertical direction (in other words, inclined rearwardly and upwardly), and by means of the elevator base 61 sliding inside the supporting column 22, the position of the contact surface 21*a* of the seat 21 can be adjusted in a single straight line following the center line of the supporting column 22, in the vertical direction. In other words, the position of the contact surface 21*a* of the seat 21 is adjusted in the left-right direction simultaneously with being adjusted in the vertical direction, and the further the position of the contact surface in the upward direction, the further its position in the rearward direction. The angle formed between the center line of the supporting column 22 and the base 10 is described hereinafter.

The elevator base 61 is driven to ascend and descend by an elevator driver 62 which comprises a drive motor 63. The elevator driver 62 and the elevator base 61 constitute the elevator mechanism 60. The elevator driver 62 comprises, in addition to the drive motor 63, a column-shaped fixed member 64 which is fixed to the base 10, and a movable member 65 which comprises a ball screw that screws into the fixed member 64, and employs a composition whereby the movable member 65 is advanced and retracted with respect to the fixed member 64 by decelerating the rotation of the drive motor 63 so as to rotate the movable member 65. The elevator base 61 is installed on the upper end portion of the movable member 65, and ascends and descends with the advancing or retreating movement of the movable member 65 with respect to the fixed member 64.

The elevator base 61 comprises a seating 61*a* on which the seat driver 50 is mounted, and a pair of guide plates 61*b* are provided on the lower surface of the seating 61*a*. The upper end portion of the movable member 65 in the elevator driver 62 is coupled to the lower surface side of the seating 61*a*. Furthermore, rollers 61*c* are installed on the outer surfaces of the guide plates 61*b*, and by guiding these rollers 61*c* in rail sections 22*a* provided on the inner surface of the supporting column 22, it is possible to move the elevator base 61 smoothly with respect to the supporting column 22. A position sensor 68 which determines the amount of advance or retreat of the movable member 65 with respect to the fixed member 64 is provided, and the rotation of the drive motor 63 is controlled in such a manner that the value determined by the position sensor 68 coincides with a target value specified in accordance with an input via the control and display apparatus unit 32. Further description of this is provided later.

A tubular elevator cover 66 is attached to the seating 61*a* of the elevator base 61. The lower end portion of the elevator cover 66 overlaps with the outer surface of the supporting column 22 in the range of extension and contraction of the elevator driver 62, and by this means the elevator base 61 is not exposed to the exterior even when the elevator driver 62 is extended by the maximum amount. Moreover, a mechanical unit cover 67 formed from a cloth-like soft material is attached to the seating 61*a* of the elevator base 61. The mechanical unit cover 67 prevents the seat driver 50 from being exposed to the exterior by covering the portion between the seating 61*a* and the seat 21.

Figure 5:
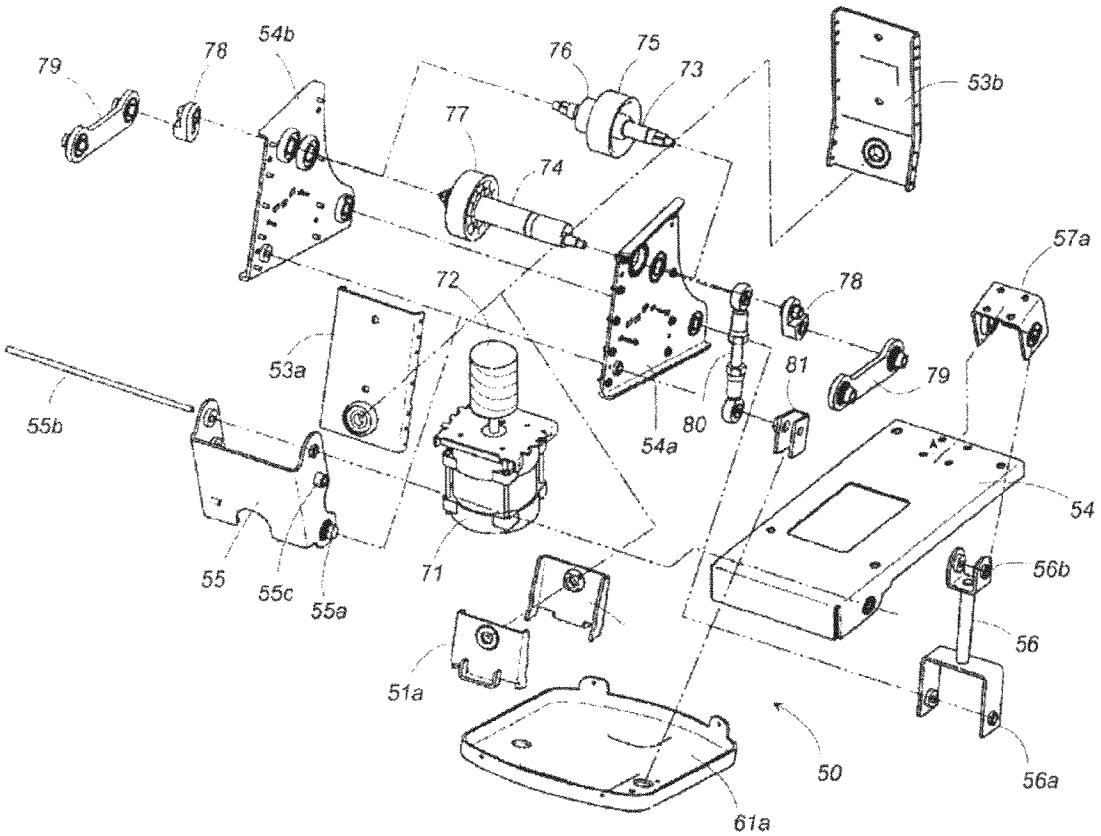
FIG. 5 is an exploded perspective diagram of a seat driving section used in the exercise assisting apparatus.
Figure 6:
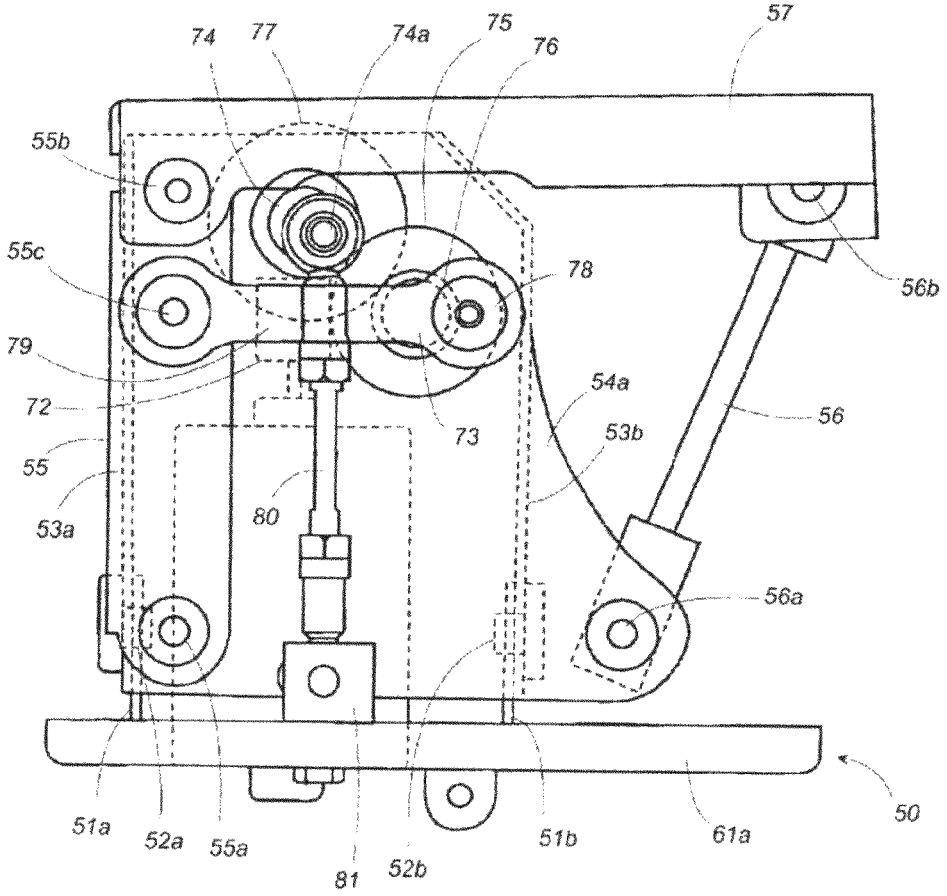
FIG. 6 is an side view diagram of a seat driving section used in the exercise assisting apparatus.

Next, the seat driver 50 is described with reference to FIG. 5 and FIG. 6. The seat driver 50 constitutes a mechanism which causes the seat 21 to oscillate together with the seating 61*a* of the elevator base 61, and is installed axially on a front and rear pair of axle plates 51*a*, 51*b* which are provided in an upright fashion on the upper surface of the seating 61*a* and axles 52*a*, 52*b*. The front and rear axles 52*a*, 52*b* are disposed coaxially, and by means of the seat driver 50 rotating about these axles 52*a*, 52*b*, the seat 21 which is coupled to the seat driver 50 can be caused to oscillate leftwards and rightwards (in the directions indicated by arrow N in FIG. 4).

The seat driver 50 comprises a front and rear pair of frame plates 53*a*, 53*b*, and these two frame plates 53*a*, 53*b* are coupled via a left and right-hand pair of frame side plates 54*a*, 54*b*. The lower end portions of a front link 55 and a rear link 56 which rotate about an axis in the left/right direction are installed axially by means of axles 55*a*, 56*a* on the two frame side plates 54*a*, 54*b*, and the upper end portions of the front link 55 and the rear link 56 are installed axially on a base plate 57 by means of axles 55*b* and 56*b*. Here, the upper end portion of the rear link 56 is installed axially on a bearing plate 57*a* which is fixed to a base plate 57 rather than being axially installed directly on the base plate 57.

The range of movement of the base plate 57 is restricted in such a manner that the front end portion of the base plate 57 moves through a circular arc centered on the axle 55*a*, and the rear end portion of the base plate 57 moves through a circular arc centered on the axle 56*a*. Here, the rear link 56 is formed to a longer dimension than the front link 55, and hence the front end portion and the rear end portion of the base plate 57 have different radii of curvature, whereby the angle of inclination of the upper surface changes as the base plate 57 moves forwards and rearwards. More specifically, if the position shown in FIG. 6 is taken as the rear end position of the range of movement in the forward/rearward direction, then as the base plate moves forward, the front end portion of the base plate 57 descends relatively with respect to the rear end portion thereof, thereby increasing the angle of inclination of the upper surface. Conversely, if the base plate is moved rearwards from the front end position, the front end portion of the base plate 57 rises upwards relatively with respect to the rear end portion, thereby reducing the angle of inclination of the upper surface. In other words, the seat 21 can be moved in the forward/rearward direction (the direction indicated by arrow X in FIG. 4). FIG. 4 depicts linear movement, but in actual practice, because the angle of inclination of the forward/rearward direction changes, then the displacement combines a linear movement and a rotational movement in the forward/rearward direction.

The motor 71 which is a drive source for oscillating the base plate 57 with respect to the base plate 61*a* is held by both frame side plates 54*a* and 54*b*. Furthermore, the motor 71 is disposed vertically in such a manner that the output shaft thereof projects in the upward direction. A worm gear 72 is coupled to the output shaft of the motor 71. A first shaft 73 and a second shaft 74 are supported on the frame side plates 54*a* and 54*b*, and a worm wheel 75 which meshes with the worm gear 72 is provided on the first shaft 73. A gear 76 is also provided on the first shaft 73 and the gear 76 meshes with a gear 77 which is provided on the second shaft 74.

Eccentric cranks 78 which rotate together with the first shaft 73 are attached respectively to either end of the first shaft 73. One end of an arm link 79 is axially installed respectively on each eccentric crank 78, and the other ends of the arm links 79 are axially installed respectively on axle pins 55*c* which project to the left and right of the front link 55.

By means of this composition, when the motor 71 turns and the first shaft 73 rotates, the front link 55 moves back and forth reciprocally in the forward/rearward direction about the axles 55*a* due to the eccentric cranks 78 and the aim links 79, and the front portion of the base plate 57 oscillates in the forward/rearward direction about the axles 55*a* (the direction indicated by arrow X in FIG. 4). Furthermore, after the rear link 56 has turned about the axles 56*a*, the angle of inclination of the upper surface changes with the movement of the base plate 57 in the forward/rearward direction.

On the other hand, an eccentric pin 74*a* is provided in a standing fashion on one end portion of the second shaft 74, and one end portion of an eccentric rod 80 is installed axially on this eccentric pin 74*a*. The other end portion of the eccentric rod 80 is coupled in an oscillatable fashion to a coupling piece 81 which is attached to the seating 61*a*. The pin 74*a* and the eccentric rod 80 may be provided on either the left or right-hand side of the seat driver 50.

By means of this composition, if the motor 71 is turned and the second shaft 74 is rotated via the first shaft 73, then the height position of the eccentric pin 74*a* with respect to the seating 61*a* changes with the pin 74*a* and the eccentric rod 80, and as a result, the base plate 57 oscillates leftwards and rightwards about the axles 52*a* and 52*b* (the direction indicated by arrow N in FIG. 4).

A brushless DC motor, or the like, is used for the motor 71, and a DC motor is also used for the drive motor 63. Here, since the motor 63 is disposed in a space which is surrounded by the frame plates 53*a*, 53*b*, the frame side plates 54*a*, 54*b*, the seating 61*a* and the base plate 57, and since the gears 75 to 77 are also disposed in the same space, then the seat driver 50 is compact.

Basically, the seat driver 50 moves the seat 21 in a rightward forward and downward direction and a leftward forward and downward direction. However, in the composition described above, by appropriately setting the gear ratios of the gears 76 and 77, and the phase differential between the eccentric crank 78 and the eccentric pin 74*a*, then apart from a V-shaped path of movement of the seat 21 (where two reciprocal forward and rearward movements are performed during one reciprocal movement in the left/right direction), the path of movement of the seat 21 can also be set to a W shape (where four reciprocal forward and rearward movements are performed during one reciprocal movement in the left/right direction), or a figure of eight shape (where two reciprocal forward and rearward movements are performed during one reciprocal movement in the left/right direction and the rear end positions are skewed to the left and right-hand sides), and so on.

The operation and halting of the drive motor 63 and the motor 71 are commanded by operating the control and display apparatus 32. In other words, a control section for instructing the operation or halting of the motor 71 and the speed of revolution of the motor 71 is provided in the control and display apparatus 32, and hence the exercise time period and the exercise intensity can be specified. Furthermore, a control section for raising or lowering the seat 21 is provided in such a manner that the knee bending angle θ assumes an appropriate angle. The control section and the display section provided in the control and display apparatus 32 are connected to the operation of the motor 71 and the drive motor 63 by means of a control circuit (not illustrated).

In the exercise assisting apparatus described above, it is necessary to keep the knee bending angle θ at an appropriate angle in order to promote contraction of the thigh muscle group without causing knee pain, even in the case of a user M who suffers from knee pain. In other words, the movement is of a kind whereby the weight of the user acting on the thighs is changed in a state where the knee has previously been bent to a prescribed angle in a squatting movement; during use, the user's feet are fixed in position by resting on the foot stand 40, and in order to increase the load acting on the thigh, it is desirable that the knee joint and the foot joint should coincide in the vertical direction. Therefore, due to these restricting conditions, the knee bending angle θ is governed by the position of the seat 21. Leg dimensions vary between different individuals, and change significantly with the height of the user M.

As described above, the height position of the seat 21 is adjustable by means of the elevator mechanism 60, and furthermore, by moving the seat 21 in a straight line which is inclined rearwards with respect to the base 10, the elevator mechanism 60 adjusts the position of the contact surface 21*a* of the seat 21 in such a manner that the further the contact surface moves upwards, the further the contact surface is positioned rearwards.

Below, the relationship between the manipulator section provided in the display and manipulator apparatus 32 and the control of the drive motor 63 which is the drive source of the elevator mechanism 60 and the motor 71 which is the drive source of the seat driving section 50 will be described. As shown in FIG. 3, the manipulator and display apparatus 32 comprises a physique designating section 81 which designates one of a plurality of divided physique classes, and a moving direction instructing section 82 which instructs a direction in which the seat 21 is moved.

The physique designating section 81 comprises a plurality of pushbuttons (in the illustrated example, five pushbuttons), each button corresponding to a physique class. In the illustrated example, the user's height which is considered to be related to the leg length is used as the physique, and heights between 140 to 189 cm are divided every 10 cm into five classes. Desirably, the pushbuttons constituting the physique designating section 81 have a built in display lamp which indicates which of the pushbuttons has been selected. Furthermore, the moving direction instructing section 82 comprises two pushbuttons which instruct an upward and a downward direction. Moreover, it is also possible to use the weight, or a combination of the height and weight, as the physique classes.

A pushbutton forming a final instructing section 83 for issuing a final instruction of regulating the position of the seat 21, and a pushbutton forming a power switch 84 for instructing on/off switching of the power supply, are also provided on the display and manipulator apparatus 32.

The physique designating section 81, the moving direction instructing section 82 and the final instructing section 83 are connected to an elevator controller 80 which controls the elevator mechanism 60. The elevator controller 80 is an electric circuit constituted principally by a microcomputer, which controls the drive motor 63 as well as controlling the disabling and enabling of operation of the motor 71, in accordance with the instruction contents of the manipulator section of the display and manipulator apparatus 32.

More specifically, the elevator controller 80 comprises a data memory 85 which associates a position of the elevator mechanism 60 with each physique class that may be selected by the physique designating section 81, and a position adjusting section 86 which reads out from the data memory 85 a position corresponding to a physique class when a physique class has been selected by the physique designating section 81 and drives the drive motor 63 accordingly. The position adjustment section 86 drives the drive motor 63 in such a manner that the position determined by a position sensor 68 attached to the elevator mechanism 60 (which corresponds to the position of the contact surface 21*a* of the seat 21) coincides with the position read out from the data memory 85. In other words, the position read out from the data memory 85 by the operation of the manipulator section is taken as a target position, and the position of the elevator mechanism 60 can be made to coincide with a position corresponding to the physique class by halting the drive motor 63 when the position determined by the position sensor 68 during operation of the drive motor 63 coincides with the target position.

The position sensor 68 may adopt any composition, and may employ a rotary encoder which determines the amount of rotation of the drive motor 63, a distance sensor which measures the distance from a fixed position to the elevator base 61 in the elevator mechanism 60, or a differential transformer which directly determines the amount of advance or retreat of the movable member 65 with respect to the fixed member 64. Furthermore, it is also possible to determine the position of the elevator mechanism 60 without providing a position sensor 68 by determining the amount of rotation of the drive motor 63 from the change in the load current, or the like.

A position modifying section 87 which rotates the drive motor 63 while the pushbutton in the moving direction instructing section 82 is pressed down is provided in the elevator controller 80. The position modifying section 87 is provided in order to make precise adjustment of the position of the elevator mechanism 60 which has been read out from the data memory 85 in accordance with the physique class selected by the physique designating section 81, and causes the drive motor 63 to turn at slow speed in such a manner that the elevator mechanism 60 moves in the direction instructed by the moving direction instructing section 82. The moving direction instructing section 82 halts the drive motor 63 when the pressing of the pushbutton is halted.

No particular restrictions need to be placed on the range of adjustment of the elevator mechanism 60 by the moving direction instructing section 82, but desirably the adjustment is within the range of positions corresponding to adjacent physique classes. For example, if the physique class of height 150 cm to 159 cm has been selected, then the range of movement of the elevator mechanism 60 is desirably between a position for a physique class of 140 cm to 149 cm and a position for a physique class of 160 cm to 169 cm. By setting this range of movement, it is clearly implicated that after roughly setting the position of the seat 21 by selecting a physique class via the physique designating section 81, the seat 21 is regulated to a proper position by precise adjustment of the position of the seat 21 by means of the moving direction instructing section 82.

Figure 7:
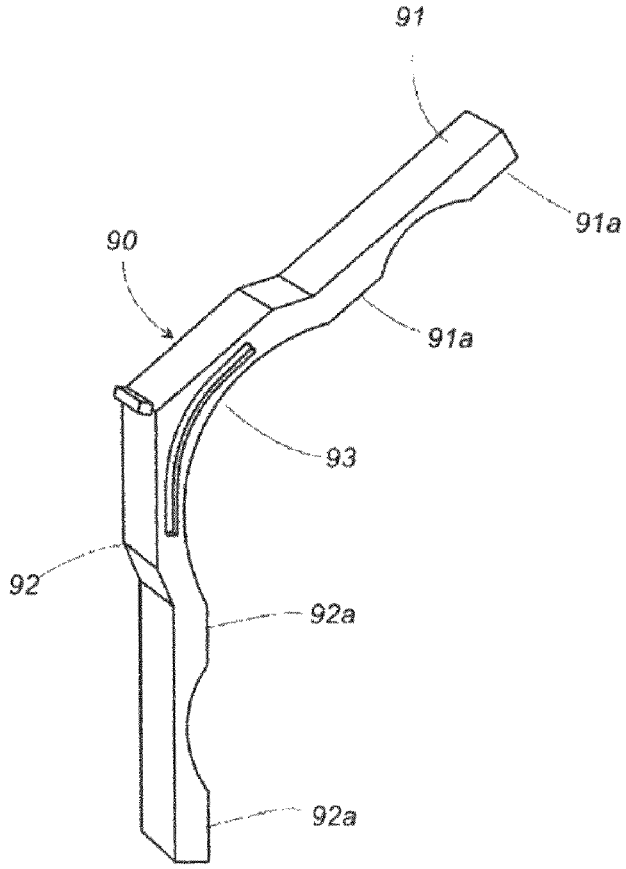
FIG. 7 is a perspective diagram showing a knee angle ruler used in the exercise assisting apparatus.

The proper position of the seat 21 means a position at which the user M's knee bending angle θ becomes a proper angle, and when operating the moving direction instructing section 82, it is necessary to measure whether or not the knee bending angle θ has become the proper angle. Therefore, the knee bending angle θ is measured by using a knee angle ruler 90 having the shape shown in FIG. 7. The knee angle ruler 90 has an L shape and comprises a thigh piece 91 which abuts against the front face of the user's thigh and a lower leg piece 92 which abuts against the front face of the user's lower leg, these pieces being connected together to form a single continuous body.

Abutting sections 91*a* and 92*a* which abut against the thigh and the lower leg are formed respectively in two positions each on the thigh piece 91 and the lower leg piece 92. The front end surface of each abutting section 91*a*, 92*a* is a flat surface which extends in the lengthwise direction of the thigh piece 91 or lower leg piece 92, and the two abutting sections 91*a* of the thigh piece 91 are disposed in a single plane, while the two abutting sections 92*a* of the lower leg piece 92 are disposed in a different single plane. The angle of intersection between the two planes is set to a proper angle of the knee bending angle θ.

A recess section 93 is formed on the inner side of the intersecting portion between the thigh piece 91 and the lower leg piece 92 (the portion which opposes the front face of the knee) in order to avoid contact between the front face of the knee and the knee angle ruler 90 when the knee angle ruler 90 is placed against the user's leg.

If a knee angle ruler 90 of this kind is placed against the user's leg centered on the knee, then if the knee bending angle θ is a proper angle, the two abutting sections 91*a* of the thigh piece 91 and the two abutting sections 92*a* of the lower leg piece 92 respectively make contact with the front face of the thigh and the front face of the lower leg, and therefore if the knee bending angle θ is adjusted so as to achieve this state, then it can be identified that the knee bending angle θ is a proper angle.

Consequently, the user M firstly sets the position of the seat 21 roughly by selecting his or her own physique class by means of the physique designating section 81, whereupon, while seated on the seat 21, the user places, for example, the front face of his or her lower leg in contact with the two abutting sections 92*a* provided on the lower leg pieces 92 of the bending angle ruler 90, and regulates the position of the seat 21 precisely by using the moving direction instructing section 82. If the two abutting sections 91*a* provided on the thigh piece 91 make contact with the front face of the user's thigh during this, then this means that the knee bending angle θ has become the proper angle, and therefore the movement of the seat 21 by the moving direction instructing section 82 is halted. By means of a method of this kind, it is possible to make the position of the seat 21 coincide with a proper position, in account of individual differences between users M.

Since it is problematic if the seat 21 is driven while regulating the position of the seat 21 as described above, then desirably the driving of the seat 21 is disabled during the regulation of the position of the seat 21 and conversely, the regulation of the seat position is disabled after driving of the seat 21 has started. The elevator controller 80 allows movement of the elevator mechanism 60 and disables operation of the seat driving section 50, until the final instructing section 83 provided in the display and manipulator apparatus 32 is operated.

On the other hand, if the final instructing section 83 is operated by pressing after the position of the seat 21 has been regulated in such a manner that the knee bending angle θ has become a proper angle as described above, then the elevator controller 80 disables the driving of the elevator mechanism 60 by the physique designating section 81 and the moving direction instructing section 82, and allows driving of the seat 21 by the seat driving section 50. In a state where driving of the seat 21 is allowed, the seat 21 starts to be driven by the seat driving section 50 when a start button, or the like, (not illustrated) is operated. In other words, oscillation of the seat 21 by the seat driving section 50 is disabled until the position of the seat 21 is confirmed by the final instructing section 83, and therefore exercising does not start until after the user M has adjusted the seat 21 to a proper position and hence it is possible to prevent exercise from being started unintentionally while the knee bending angle θ is being adjusted to the proper angle.

The seat 21 is halted in a reference position (for example, a rearmost position in the forward/rearward direction and a central position in the left/right direction), while the position of the seat 21 is regulated by the elevator mechanism 60. Furthermore, the position where the user M places his or her buttocks on the contact surface 21*a* of the seat 21 and the position where the user M places his or her feet on the foot supporting surface 40*a* of the foot stand 40 are restricted to the same positions while the position of the seat 21 is being regulated by the elevator mechanism 60 and while the seat 21 is being oscillated by the seat driving section 50.

Unless the position of the seat 21 has been adjusted properly, it is not possible to perform exercise with the knee bending angle θ at a proper angle, and since the proper position of the seat 21 differs for each respective user M, if the apparatus is shared by a plurality of users M, then it may be necessary to adjust the position of the seat 21 each time the apparatus is used. Therefore, the elevator controller 80 is provided with a position memory 88 which stores the position of the seat 21 when the final instructing section 83 is pressed, and the display and manipulator apparatus 32 is provided with a pre-position instructing section 89 which calls out a position stored in the position memory 88 and indicates this position for use as a target position of the elevator mechanism 60. By means of this composition, it is possible to make the position of the seat 21 coincide with the position in a previous exercise session, by operating the pre-position instructing section 89, and therefore usability is improved.

Furthermore, if the pre-position instructing section 89 is used, then since the apparatus is often shared by a plurality of people, seat positions for a plurality of people using the seat 21 are stored in the position memory 88 and a position for an individual person can be instructed via the pre-position instructing section 89. In other words, pushbuttons which function as user selectors 89*a* are provided on the pre-position instructing section 89 and a position for a user M can be read out from the position memory 88 by operating a user selector 89*a*. The user selectors 89*a* may employ either a composition whereby one pushbutton is provided and respective users are selected sequentially each time the pushbutton is operated, or a composition whereby pushbuttons are provided in accordance with the number of users and respective users are selected by pressing different buttons. This latter composition is adopted in the illustrated example. By providing a user selector 89*a*, it is possible to align the position of the seat 21 automatically, simply by the user selecting him or herself with the user selector 89*a*.

It is also possible to provide pressure sensors or pushbutton switches (not illustrated) respectively on each of the abutting sections 91*a* and 92*a* of the knee angle ruler 90, in such a manner that it is judged that the knee bending angle θ has become a proper angle when the pressures determined by these pressure sensors are within a prescribed range (or when the contacts in all of the pushbutton switches have been reversed), and similarly to the operation of the final instructing section 83, the movement of the elevator mechanism 60 is halted and the driving of the seat 21 by the motor 71 is allowed. The state of disabling the movement of the elevator mechanism 60 can be reset by turning on the power switch 84 again. Alternatively, it is also possible to provide a load sensor (as used in the second embodiment) in the seat 21 or foot stand 40 and to reset the state of disabling the movement of the elevator mechanism 60 when the load of the user M ceases to be detected by the load sensor.

Second Embodiment

Figure 8:
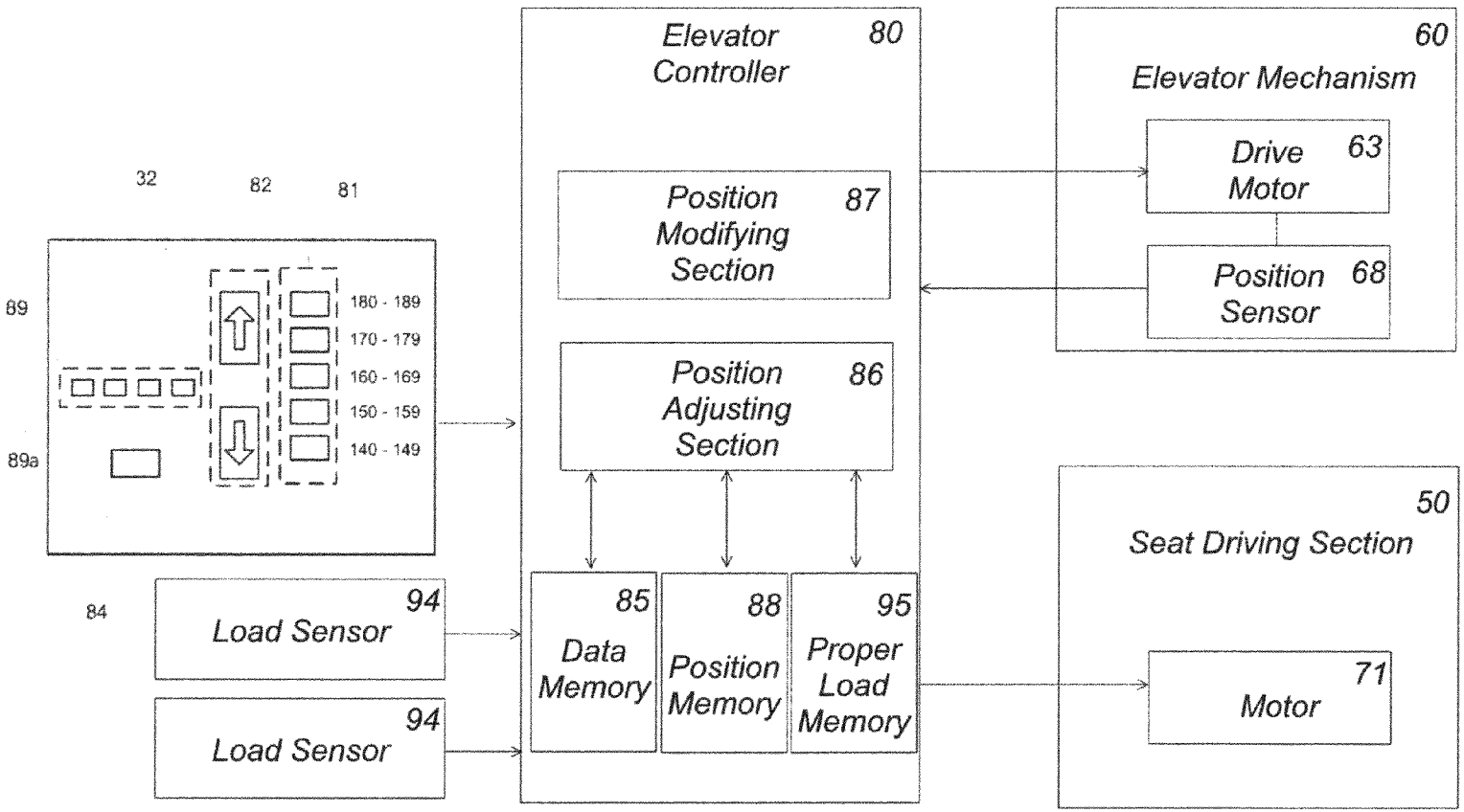
FIG. 8 is a block diagram showing the principal parts of an exercise assisting apparatus relating to a second embodiment of the present invention.

As shown in FIG. 8, the exercise assisting apparatus relating to a second embodiment of the present invention uses a load sensor 94 instead of the knee angle ruler 90 used in the first embodiment, and the remainder of the composition and the functions are the same as the first embodiment. Desirably, a load sensor 94 determines both the load acting on the contact surface 21*a* of the seat 21 and the load acting on the foot supporting surface 40*a* of the foot stand 40, but by providing a sensor in only one of these and comparing a state of measuring the full body weight of the user M and a state of measuring the load when the user's feet and buttocks are supported, it is possible to obtain information similar to that obtained by providing a sensor in both the seat 21 and the foot stand 40.

Below, an example is described in which a load sensor 94 is provided in both the seat 21 and the foot stand 40. In a state where the buttocks of the user M are placed on a prescribed position on the contact surface 21*a* of the seat 21 and the feet of the user M are placed on a prescribed position on the foot supporting surface 40*a* of the foot stand 40, the ratio of the load received by each of the load sensors 94 has a correlation to the knee bending angle θ. In other words, if the knee bending angle θ is around the proper angle, then the smaller the angle θ, the greater the relative load received by the foot stand 40, while the greater the angle θ, the greater the relative load received by the seat 21. Therefore, if the relationship between the loads determined by the respective load sensors 94 when the angle θ is a proper angle is measured in respect of a plurality of users M, and the average value thereof is stored in a proper load memory 95 as a representative value, then it is possible to judge whether or not the knee bending angle θ is a proper angle by using the loads determined by the load sensors 94. It is also possible to store the ratio between the loads determined by the load sensors 94 in the proper load memory 95.

In this composition, the position of the elevator mechanism 60 is adjusted automatically on the basis of the output value of the load sensor 94, and the elevator controller 80 regulates the position of the seat 21 by driving the elevator mechanism 60 in such a manner that the output values of the load sensors 94 (in other words, the ratio between the output values of the load sensors 94) coincides with a stored value in the proper load memory 95, and the elevator controller 80 disables the displacement of the seat 21 while the seat position is being regulated. Furthermore, after positional adjustment has been completed (after the ratio of the output values of the two load sensors 94 has been made to coincide with a stored value in the proper load memory 95), the movement of the elevator mechanism 60 is halted and displacement of the position of the seat 21 by the seat driving section 50 is allowed. Consequently, the exercise assisting apparatus relating to the present embodiment does not require a knee angle ruler 90 and neither does it require a final instructing section 83.

If only one load sensor 94 is provided, then after measuring the full body weight of the user M by this load sensor 94, a measurement is made by the load sensor 40 in a state where the weight of the user M is distributed between the seat 21 and the foot stand 40, and a value corresponding to the ratio of loads determined by two load sensors 94 is found on the basis of these two measurement values.

The invention claimed is:

1. An exercise assisting apparatus comprising:

a seat having a contact surface configured to support thereon buttocks of a user with the user's feet resting on a predetermined foot supporting surface;

a driving source;

a seat driving section configured to use the driving source and displace said seat in a direction of varying the user's weight acting on the user's legs;

an elevator mechanism configured to regulate a position of said contact surface of the seat in order to keep a user's knee bending angle at a prescribed angle while the user is sitting on the seat held at a reference position with the user's feet placed on a predetermined position on said predetermined foot supporting surface;

a manipulator section configured to instruct the position of said contact surface of the seat to be regulated by said elevator mechanism; and an elevator controller configured to control said elevator mechanism for regulating the position of said seat in accordance with an instruction of said manipulator section;

wherein said manipulator section comprises:

a plurality of physique designating sections configured to select one of physique classes classified according to a predetermined physiques of the user; and a moving direction instructing section configured to instruct a direction of moving said seat, and wherein said elevator controller comprises:

a data memory configured to store a relationship between each of the physique classes and a position of the elevator mechanism corresponding to the position of said seat;

a position adjusting section configured to move said elevator mechanism to the position determined in said data memory as associated with physique class designated by said physique designating section; and a position modifying section configured to move said elevator mechanism in a direction instructed by said moving direction instructing section and while said direction is being instructed.

2. The exercise assisting apparatus as set forth in claim 1, wherein said manipulator section includes a final instructing section configured to provide a final instruction of regulating the position of the seat by said elevator mechanism to said elevator controller, said elevator controller being configured to disable said seat driving section from displacing said seat until said final instruction section is operated, and said elevator controller being configured to disable said elevator mechanism from moving, but to allow said seat driving section to displace said seat after said final instruction section is operated.

3. The exercise assisting apparatus as set forth in claim 1, further including:

a load sensor configured to detect a load acting on at least one of said seat and said predetermined foot supporting surface, and a load memory configured to store an output value of said load sensor as a value when the user's knees are bent at the prescribed angle with the user's buttocks placed on said seat held at said reference position and with the user's feet resting on said predetermined foot supporting surface, said elevator controller being configured to disable said seat driving section from displacing said seat until the output from said load sensor becomes coincident with the value stored in said load memory while moving said elevator mechanism, and to stop moving said elevator mechanism and allow said seat driving section to displace said seat after the output from said load sensor coincides with the value stored in said load memory.

4. The exercise assisting apparatus as set forth in claim 1, wherein said elevator controller comprises a position memory configured to store a position of said elevator mechanism when said seat driving section starts displacing said seat, and said manipulator section comprises a pre-position instructing section configured to move said elevator mechanism to the position stored in said position memory.

5. The exercise assisting apparatus as set forth in claim 4, wherein said position memory includes memory areas configured to store the positions of said elevator mechanism with regard to a plurality of users, and said pre-position instructing section comprises a user selector configured to select one of the positions stored respectively in said memory areas of said position memory for instruction of the position of said elevator mechanism.

6. The exercise assisting apparatus as set forth in claim 1, wherein said elevator mechanism comprises a position sensor configured to detect a position corresponding to the contact surface of said seat, said position adjusting section being configured to determine the position instructed by said manipulator section as a target position, and stop said elevator mechanism when said position sensor provides an output which corresponds to said target position while said elevator mechanism is moving.

7. An exercise assisting apparatus comprising:

a seat having a contact surface configured to support thereon buttocks of a user with the user's feet resting on a predetermined foot supporting surface a driving source;

a seat driving section configured to use the driving source and displace said seat in a direction of varying the user's weight acting on the user's legs;

an elevator mechanism configured to regulate a position of said contact surface of the seat in order to keep a user's knee bending angle at a prescribed angle while the user is sitting on the seat held at a reference position with the user's feet placed on a predetermined position on said predetermined foot supporting surface;

a manipulator section configured to instruct the position of said contact surface of the seat to be regulated by said elevator mechanism; and an elevator controller configured to control said elevator mechanism for regulating the position of said seat in accordance with an instruction of said manipulator section;

wherein said manipulator section comprises:

a plurality of physique designating sections configured to enable the designation of one of physique classes which are classified in correspondence to predetermined physiques of users; and a moving direction instructing section configured to instruct a direction of moving said seat, and wherein said elevator controller comprises:

a data memory configured to store a relationship between each of the physique classes and a position of the elevator mechanism corresponding to the position of said seat;

a position adjusting section configured to move said elevator mechanism to the position determined in said data memory as associated with physique class designated by said physique designating section; and a position modifying section configured to move said elevator mechanism in a direction instructed by said moving direction instructing section and while said direction is being instructed.

8. The exercise assisting apparatus as set forth in claim 7, wherein said manipulator section includes a final instructing section configured to provide a final instruction of regulating the position of the seat by said elevator mechanism to said elevator controller, said elevator controller being configured to disable said seat driving section from displacing said seat until said final instruction section is operated, and said elevator controller being configured to disable said elevator mechanism from moving, but to allow said seat driving section to displace said seat after said final instruction section is operated.

9. The exercise assisting apparatus as set forth in claim 7, further including:

a load sensor configured to detect a load acting on at least one of said seat and said predetermined foot supporting surface, and a load memory configured to store an output value of said load sensor as a value when the user's knees are bent at the prescribed angle with the user's buttocks placed on said seat held at said reference position and with the user's feet resting on said predetermined foot supporting surface, said elevator controller being configured to disable said seat driving section from displacing said seat until the output from said load sensor becomes coincident with the value stored in said load memory while moving said elevator mechanism, and to stop moving said elevator mechanism and allow said seat driving section to displace said seat after the output from said load sensor coincides with the value stored in said load memory.

10. The exercise assisting apparatus as set forth in claim 7, wherein said elevator controller comprises a position memory configured to store a position of said elevator mechanism when said seat driving section starts displacing said seat, and said manipulator section comprises a pre-position instructing section configured to move said elevator mechanism to the position stored in said position memory.

11. The exercise assisting apparatus as set forth in claim 10, wherein said position memory includes memory areas configured to store the positions of said elevator mechanism with regard to a plurality of users, and said pre-position instructing section comprises a user selector configured to select one of the positions stored respectively in said memory areas of said position memory for instruction of the position of said elevator mechanism.

12. The exercise assisting apparatus as set forth in claim 7, wherein said elevator mechanism comprises a position sensor configured to detect a position corresponding to the contact surface of said seat, said position adjusting section being configured to determine the position instructed by said manipulator section as a target position, and stop said elevator mechanism when said position sensor provides an output which corresponds to said target position while said elevator mechanism is moving.

* * * * *